US007334293B2

(12) United States Patent
Erickson et al.

(10) Patent No.: US 7,334,293 B2
(45) Date of Patent: Feb. 26, 2008

(54) VERTICALLY ADJUSTABLE HINGE

(75) Inventors: Gary M. Erickson, Lena, IL (US); Scott J. Rote, New Lenox, IL (US); Scott Zeeb, Chicago, IL (US); Todd K. Ellerton, Roscoe, IL (US); Michael D. Smith, Winnebago, IL (US)

(73) Assignee: Newell Operating Company, Atlanta, GA (US)

( * ) Notice: Subject to any disclaimer, the term of this patent is extended or adjusted under 35 U.S.C. 154(b) by 131 days.

(21) Appl. No.: 11/058,884

(22) Filed: Feb. 16, 2005

(65) Prior Publication Data

US 2006/0179610 A1 Aug. 17, 2006

(51) Int. Cl.
*E05D 7/04* (2006.01)

(52) U.S. Cl. ..... 16/243; 16/245

(58) Field of Classification Search ..... 16/243–247, 16/239–242, 235, 236, 237, 250, 251, 382, 16/387

See application file for complete search history.

(56) References Cited

U.S. PATENT DOCUMENTS

| | | | | |
|---|---|---|---|---|
| 375,038 | A | 12/1887 | Wright | |
| 375,039 | A | 12/1887 | Wright | |
| 386,186 | A | 7/1888 | Dahlman | |
| 794,454 | A | 7/1905 | Davis et al. | |
| 880,317 | A | 2/1908 | Von De Marwitz | |
| 928,760 | A | 7/1909 | Hunter | |
| 1,002,394 | A | 9/1911 | Hanson | |
| 1,111,832 | A | 9/1914 | Hazelrigg et al. | |
| 1,314,732 | A | 9/1919 | Cochran et al. | |
| 2,373,955 | A | 4/1945 | Fuller | |
| 2,683,279 | A * | 7/1954 | Okerlund et al. | 16/245 |
| 2,940,115 | A | 6/1960 | Hansen | |
| 3,584,332 | A * | 6/1971 | Taylor | 16/245 |
| 4,106,158 | A | 8/1978 | Kellems et al. | |
| 4,141,109 | A | 2/1979 | Farrell | |
| 4,142,272 | A | 3/1979 | Oogami et al. | |
| 4,304,027 | A | 12/1981 | Di Fazio | |
| 4,330,901 | A | 5/1982 | Sanders | |
| 4,386,646 | A | 6/1983 | Matyas | |

(Continued)

FOREIGN PATENT DOCUMENTS

DE 4431799 C1 * 11/1995

(Continued)

*Primary Examiner*—Chuck Y. Mah
(74) *Attorney, Agent, or Firm*—Banner & Witcoff, Ltd.

(57) ABSTRACT

A vertically adjustable hinge is disclosed. The hinge comprises a housing for attachment to a first structure. The housing has a housing cavity and an opening into the cavity. The cavity has an upper portion, a lower portion and a retaining portion forming a channel defining the upper portion and the lower portion. The hinge further includes a first leaf extending through the cavity opening and into the cavity upper portion, threaded nut rotationally fixed to the first leaf, and an adjustment mechanism disposed in the housing cavity. The adjustment mechanism comprises a jack screw extending between the upper cavity portion and the lower cavity portion. The jack screw has a threaded portion threadably engaging the nut in the upper cavity portion and a geared portion disposed in the cavity lower portion. The hinge further includes a worm gear engaging the jack screw geared portion, wherein rotation of the worm gear rotates the jack screw threaded portion in the nut, thereby moving the first leaf relative to the housing.

27 Claims, 2 Drawing Sheets

U.S. PATENT DOCUMENTS

| | | | | |
|---|---|---|---|---|
| 4,434,523 | A | 3/1984 | Grass | |
| 4,493,129 | A | 1/1985 | Grass | |
| 4,571,774 | A | 2/1986 | Hinson | |
| 4,639,971 | A | 2/1987 | Kurtz | |
| 4,646,472 | A | 3/1987 | Sugawara | |
| 4,696,078 | A | 9/1987 | Stromquist | |
| 4,703,539 | A | 11/1987 | Lautenschlager, Jr. et al. | |
| 4,748,717 | A | 6/1988 | Osborne | |
| 4,776,061 | A | 10/1988 | Franco | |
| 4,785,498 | A | 11/1988 | Brotschi | |
| 4,815,162 | A | 3/1989 | McAteer | |
| 4,825,507 | A | 5/1989 | Killingstad | |
| 4,837,893 | A | 6/1989 | Wilson | |
| 4,893,863 | A | 1/1990 | Skonieczny et al. | |
| 4,925,507 | A | 5/1990 | Yamaguchi | |
| 4,937,916 | A | 7/1990 | Redman | |
| 4,985,939 | A | 1/1991 | Otte | |
| 5,029,363 | A | 7/1991 | Hesener | |
| 5,056,190 | A | 10/1991 | Rock et al. | |
| 5,058,236 | A | 10/1991 | Henson | |
| 5,074,609 | A | 12/1991 | Dear | |
| 5,133,109 | A | 7/1992 | Mariani | |
| 5,144,721 | A | 9/1992 | Schade | |
| 5,283,929 | A | 2/1994 | Lin | |
| 5,339,493 | A | 8/1994 | MacIntyre | |
| 5,379,487 | A | 1/1995 | Bowers | |
| 5,419,640 | A | 5/1995 | Doring | |
| 5,694,665 | A | 12/1997 | Strickland et al. | |
| 5,701,636 | A | 12/1997 | Jahnke | |
| 5,713,105 | A | 2/1998 | Toomey | |
| 5,755,011 | A | 5/1998 | Green et al. | |
| 5,799,370 | A | 9/1998 | Davidian et al. | |
| 5,806,144 | A | 9/1998 | Fries | |
| 6,049,946 | A | 4/2000 | Cress et al. | |
| 6,134,750 | A | 10/2000 | Salice | |
| 6,202,255 | B1 | 3/2001 | Sitter | |
| 6,212,734 | B1 | 4/2001 | Commons | |
| 6,397,432 | B1 | 6/2002 | di Vinadio | |
| 6,484,363 | B1 | 11/2002 | Chung | |
| 6,516,494 | B2 | 2/2003 | Nakamoto et al. | |
| 6,643,895 | B1 | 11/2003 | Domenig et al. | |
| 6,647,591 | B1 | 11/2003 | Domenig et al. | |
| 6,715,181 | B1 * | 4/2004 | Fries | 16/271 |
| 2002/0166207 | A1 | 11/2002 | Egger et al. | |
| 2003/0066164 | A1 | 4/2003 | Domenig | |
| 2004/0205932 | A1 * | 10/2004 | Sitter | 16/250 |

FOREIGN PATENT DOCUMENTS

| | | | |
|---|---|---|---|
| EP | 919685 | A1 * | 6/1999 |
| GB | 679658 | | 9/1952 |
| GB | 911559 | | 11/1962 |
| GB | 1045702 | | 10/1966 |
| JP | 03137381 | A * | 6/1991 |
| JP | 3-187486 | | 8/1991 |
| JP | 09158594 | A * | 6/1997 |
| JP | 10331508 | A * | 12/1998 |

* cited by examiner

VERTICALLY ADJUSTABLE HINGE

CROSS-REFERENCE TO RELATED APPLICATIONS

None

FEDERALLY SPONSORED RESEARCH OR DEVELOPMENT

Not Applicable.

TECHNICAL FIELD

The present invention relates to a vertically adjustable hinge, such as for mounting a door to a door frame.

BACKGROUND OF THE INVENTION

Various vertically adjustable hinges have been provided. See, for example, Green et al., U.S. Pat. No. 5,755,011; Killingstad, U.S. Pat. No. 4,825,507; MacIntyre, U.S. Pat. No. 5,339,493; Jahnke, U.S. Pat. No. 5,701,636; and Toomey, U.S. Pat. No. 5,713,105.

DETAILED DESCRIPTION OF A PREFERRED EMBODIMENT

Figure 1:
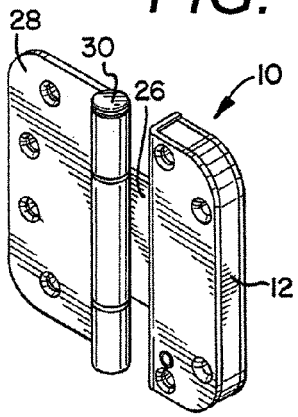
FIG. 1 is a perspective view of a vertically adjustable hinge according to the present invention.
Figure 2:
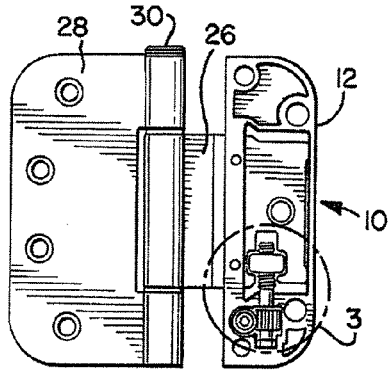
FIG. 2 is a front view of the hinge of FIG. 1, with cover plate removed and exposing an adjustment mechanism.
Figure 3:
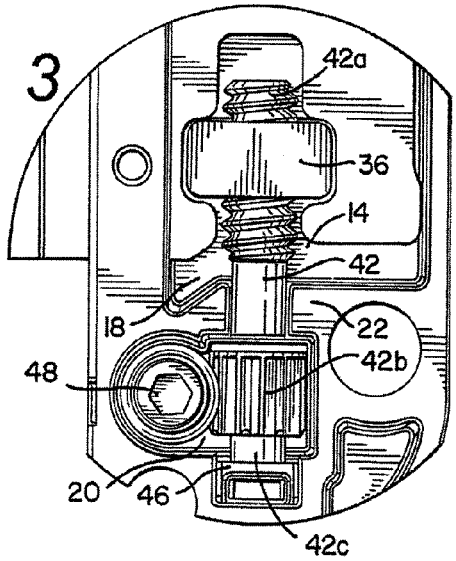
FIG. 3 is a detail of FIG. 2.
Figure 4:
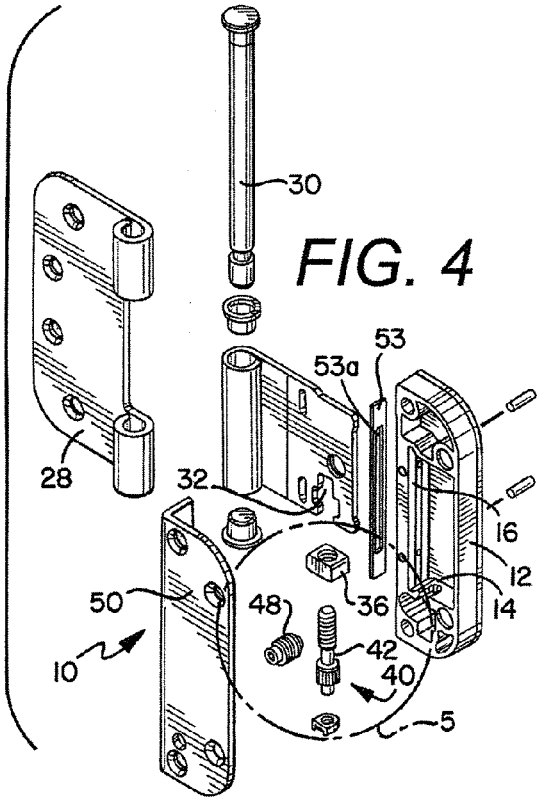
FIG. 4 is an exploded view of the adjustable hinge of FIG. 1.
Figure 5:
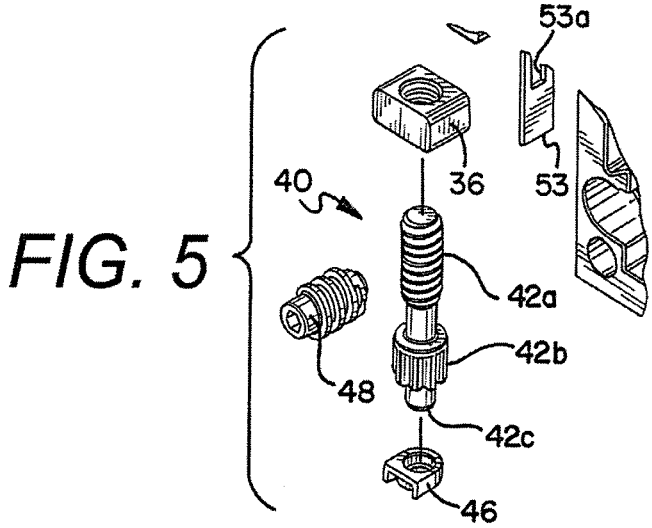
FIG. 5 is a detail of FIG. 4.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiments illustrated.

A vertically adjustable hinge 10 is illustrated in FIGS. 1-6. The hinge 10 includes a housing 12 for attachment in a conventional manner to a first structure, such as a door (not shown). The housing 12 has a housing cavity 14 and an opening 16 into the cavity 14. The cavity has an upper portion 18, a lower portion 20 and a retaining portion 22. The retaining portion 22 forms a channel defining the upper portion 18 and the lower portion 20.

The hinge 10 further includes a first leaf 26 extending through the cavity opening 16 and into the cavity upper portion 18. Additionally, the hinge 10 includes a conventional second leaf 28 for attachment to a second structure, such as a door frame (not shown). The first leaf 26 is coupled to the second leaf 28 in a conventional manner by a hinge pin 30.

The first leaf 26 has a generally t-shaped slot 32 having a vertical leg and a horizontal leg. A threaded nut 36 is rotationally fixed in the t-shaped slot horizontal leg.

The hinge 10 further includes a vertical adjustment mechanism 40 disposed in the housing cavity 14. The adjustment mechanism 40 comprises a jack screw 42 receiveably supported by the retaining portion 22 and extending between the upper cavity portion 18 and the lower cavity portion 20. The retaining portion 22 limits axial movement of the jack screw 42.

The jack screw 42 has a threaded portion 42*a* threadably engaging the nut 36 in the upper cavity portion 18 and a geared portion 42*b* disposed in the cavity lower portion 20. The jack screw 42 includes a tip portion 42*c* opposite the threaded portion 42*a*. The hinge 10 includes a bearing cup 46 to receive the tip portion 42*c*.

The adjustment mechanism 40 includes a worm gear 48 engaging the jack screw geared portion 42*b*. Rotation of the worm gear 48 rotates the jack screw threaded portion 42*b* in the nut 36, thereby moving the first leaf 26 relative to the housing 12.

The housing 12 includes a cover plate 50 having an opening 50*a* exposing the worm gear 48, to permit access to rotate the worm gear 48.

Figure 6:
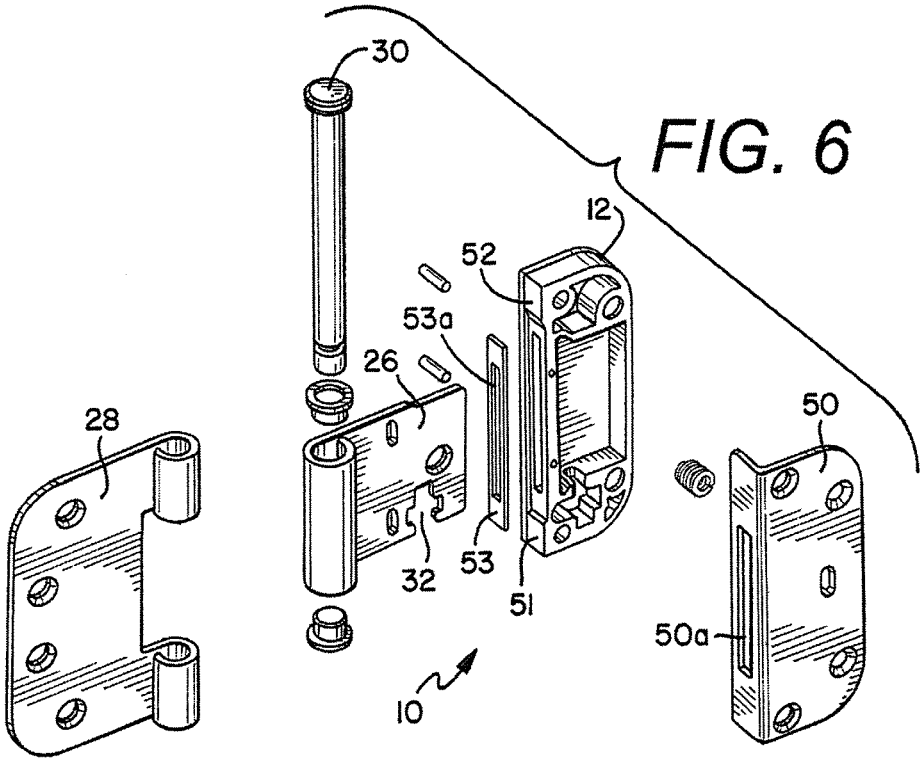
FIG. 6 is an exploded view of the adjustable hinge of FIG. 1.

Referring specifically to FIG. 6, the housing 12 further includes a housing face 51 having a recess 52 and a face opening 53 through the recess 52. A slotted plate 53 is disposed in the recess 52, and is movable relative to the recess 52. The slotted plate 53 is preferably plastic, although it could be of metal or other suitable materials. The slotted plate 53 has a slot 53*a* which receives the first leaf 26. The slot 53*a* is dimensioned substantially the same as the leaf 26 to provide a relatively snug fit there between.

With conventional adjustable hinges, whether vertically adjustable, horizontally adjustable, or both, the cavity opening 16 into the housing cavity 14 must be larger than the respective cross-section of the leaf 26, to permit the leaf 26 to adjustably move relative to the housing 12. This resulted in an undesirable appearance and permitted entrance of contaminants into the cavity 14. In the present adjustable hinge 10, the slotted plate 53 moves in the recess 52 with the first leaf 26, thereby keeping the cavity opening 16 covered and presenting an aesthetically clean appearance. While this feature has been illustrated withy respect to a vertically adjustable hinge, it should be understood that it is equally applicable to a horizontally adjustable hinge as well as to a hinge both horizontally and vertically adjustable.

While the specific embodiment has been illustrated and described, numerous modifications come to mind without significantly departing from the spirit of the invention, and the scope of protection is only limited by the scope of the accompanying claims.

What is claimed is:

1. A vertically adjustable hinge comprising:

a housing for attachment to a first structure, the housing having a housing cavity, the cavity having an upper portion, a lower portion and a retaining portion forming a channel defining the upper portion and the lower portion;

a first leaf extending into the cavity upper portion;

a threaded nut engaging the first leaf to prevent rotation of the threaded nut relative to the first leaf;

an adjustment mechanism disposed in the housing cavity, the adjustment mechanism comprising a jack screw extending between the upper cavity portion and the lower cavity portion, the jack screw having a threaded portion threadably engaging the nut in the upper cavity portion and a geared portion disposed in the cavity lower portion;

a worm gear engaging the jack screw geared portion, wherein rotation of the worm gear rotates the jack screw threaded portion in the nut, thereby moving the first leaf relative to the housing; and a second leaf pivotably attached to the first leaf.

2. The adjustable hinge of claim 1, wherein the retaining portion includes a slot for receiving the jack screw.

3. The adjustable hinge of claim 2, wherein the retaining portion limits axial movement of the jack screw.

4. The adjustable hinge of claim 1, wherein the housing includes a cover plate having an opening exposing the worm gear, to permit access to rotate the worm gear.

5. The adjustable hinge of claim 1, wherein the jack screw includes a tip portion opposite the threaded portion.

6. The adjustable hinge of claim 5, including a bearing cup to receive the tip portion.

7. The adjustable hinge of claim 1, wherein the housing further has a cavity opening, the first leaf extending into the upper cavity portion through the cavity opening, the adjustable hinge further comprising a slotted plate having a slot dimensioned substantially the same as the first leaf to receive the first leaf, disposed over the cavity opening, the slotted plate having a slot aligned with, and dimensioned smaller than, the opening to minimize entrance of contaminants into the cavity.

8. A vertically adjustable hinge comprising:

a housing for attachment to a first structure, the housing having a housing cavity and an opening into the cavity, the cavity having an upper portion, a lower portion and a retaining portion forming a channel defining the upper portion and the lower portion;

a first leaf extending into the cavity upper portion, the first leaf having a generally t-shaped slot having a vertical leg and a horizontal leg;

a threaded nut positioned in the t-shaped slot horizontal leg and engaging the first leaf to prevent rotation of the threaded nut relative to the first leaf;

an adjustment mechanism disposed in the housing cavity, the adjustment mechanism comprising a jack screw extending between the upper cavity portion and the lower cavity portion, the jack screw having a threaded portion threadably engaging the nut in the upper cavity portion and a geared portion disposed in the cavity lower portion;

a worm gear engaging the jack screw geared portion, wherein rotation of the worm gear rotates the jack screw threaded portion in the nut, thereby moving the first leaf relative to the housing; and a second leaf pivotably attached to the first leaf.

9. The adjustable hinge of claim 8, wherein the retaining portion includes a slot for receiving the jack screw.

10. The adjustable hinge of claim 9, wherein the retaining portion limits axial movement of the jack screw.

11. The adjustable hinge of claim 8, wherein the housing includes a cover plate having an opening exposing the worm gear, to permit access to rotate the worm gear.

12. The adjustable hinge of claim 8, wherein the jack screw includes a tip portion opposite the threaded portion.

13. The adjustable hinge of claim 12, including a bearing cup to receive the tip portion.

14. The adjustable hinge of claim 10, wherein the housing further has a cavity opening, the first leaf extending into the upper cavity portion through the cavity opening, the adjustable hinge further comprising a slotted plate disposed over the cavity opening, the slotted plate having a slot aligned with, and dimensioned smaller than, the opening to minimize entrance of contaminants into the cavity.

15. A vertically adjustable hinge comprising:

a housing for attachment to a first structure, the housing having a housing cavity, the cavity having an upper portion, a lower portion and a retaining portion forming a channel defining the upper portion and the lower portion;

a first leaf extending into the cavity upper portion, the first leaf having a generally t-shaped slot having a vertical leg and a horizontal leg;

a threaded nut positioned in the t-shaped slot horizontal leg and engaging the first leaf to prevent rotation of the threaded nut relative to the first leaf;

an adjustment mechanism disposed in the housing cavity, the adjustment mechanism comprising a jack screw receiveably supported by the retaining portion and extending between the upper cavity portion and the lower cavity portion, the jack screw having a threaded portion threadably engaging the nut in the upper cavity portion and a geared portion disposed in the cavity lower portion;

a worm gear engaging the jack screw geared portion, wherein rotation of the worm gear rotates the jack screw threaded portion in the nut, thereby moving the first leaf relative to the housing; and a second leaf pivotably attached to the first leaf.

16. The adjustable hinge of claim 15, wherein the retaining portion limits axial movement of the jack screw.

17. The adjustable hinge of claim 15, wherein the housing includes a cover plate having an opening exposing the worm gear, to permit access to rotate the worm gear.

18. The adjustable hinge of claim 15, wherein the jack screw includes a tip portion opposite the threaded portion.

19. The adjustable hinge of claim 18, including a bearing cup to receive the tip portion.

20. The adjustable hinge of claim 15, wherein the housing further has a cavity opening, the first leaf extending into the upper cavity portion through the cavity opening, the adjustable hinge further comprising a slotted plate disposed over the cavity opening, the slotted plate having a slot aligned with, and dimensioned smaller than, the opening to minimize entrance of contaminants into the cavity.

21. An adjustable hinge comprising:

a housing for attachment to a first structure, the housing having a housing cavity, a housing face and a cavity opening through the housing face and into the cavity;

a slotted plate adjacent the face, the slotted plate having a slot adjacent the cavity opening, the slotted plate being movable relative to the housing;

a first leaf extending through the slot and the cavity opening and into the cavity; and a second leaf pivotably attached to the first leaf.

22. The adjustable hinge of claim 21 wherein the slot is dimensioned to snugly receive the leaf.

23. The adjustable hinge of claim 21, wherein the housing has a cover plate, and the slotted plate is disposed between the housing face and the cover plate.

24. The adjustable hinge of claim 21, wherein the housing has a recess and the slotted plate is disposed within the recess.

25. An adjustable hinge comprising:

a housing having a housing cavity and a cavity opening therein;

a first leaf extending through the cavity opening and into the cavity;

a threaded nut positioned in the housing cavity, the nut engaging the first leaf to prevent rotation of the nut relative to the first leaf;

an adjustment mechanism disposed in the housing cavity, the adjustment mechanism comprising a screw having a geared portion and a threaded portion threadably engaging the nut, wherein rotation of the screw threaded portion in the nut moves the first leaf relative to the housing;

a worm gear engaging the geared portion of the screw, wherein rotation of the worm gear rotates the screw, thereby moving the first leaf relative to the housing; and a second leaf pivotably attached to the first leaf.

26. The hinge of claim 25, wherein the housing cavity has an upper portion, a lower portion and a retaining portion forming a channel defining the upper portion and the lower portion, the first leaf positioned in the upper cavity portion and the screw extending between the upper cavity portion and the lower cavity portion.

27. The hinge of claim 25, wherein the first leaf has a slot therein, the threaded nut positioned within the slot and engaging the slot to prevent rotation of the nut relative to the first leaf.

* * * * *